US011828050B1

(12) United States Patent
Wright, Jr.

(10) Patent No.: US 11,828,050 B1
(45) Date of Patent: Nov. 28, 2023

(54) GARBAGE DISPOSAL ACCESS ASSEMBLY

(71) Applicant: Ronald Wright, Jr., Vancouver, WA (US)

(72) Inventor: Ronald Wright, Jr., Vancouver, WA (US)

( * ) Notice: Subject to any disclaimer, the term of this patent is extended or adjusted under 35 U.S.C. 154(b) by 0 days.

(21) Appl. No.: 17/868,130

(22) Filed: Jul. 19, 2022

(51) Int. Cl.
*E03C 1/30* (2006.01)
*E03C 1/266* (2006.01)

(52) U.S. Cl.
CPC ..... *E03C 1/30* (2013.01); *E03C 1/2665* (2013.01)

(58) Field of Classification Search
CPC ..... E03C 1/30; E03C 1/2665
USPC ..... 4/629, 619, 630, 625, 631; 134/115; 241/46.013, 68; 361/120
See application file for complete search history.

(56) References Cited

U.S. PATENT DOCUMENTS

| | | | | |
|---|---|---|---|---|
| 4,911,492 | A | 3/1990 | Ward | |
| 5,662,404 | A | 9/1997 | Susat | |
| D484,577 | S | 12/2003 | Brue | |
| 9,238,302 | B2 * | 1/2016 | Thibodeaux | B25J 1/04 |
| D890,580 | S | 7/2020 | Brown | |
| 11,097,279 | B2 | 8/2021 | BNors | |
| 2004/0104586 | A1 | 6/2004 | Rose | |
| 2005/0276039 | A1 * | 12/2005 | Hillenbrand | E03C 1/30 362/120 |
| 2005/0276068 | A1 | 12/2005 | Hwang | |
| 2013/0327860 | A1 | 12/2013 | Harooni | |
| 2015/0151429 | A1 * | 6/2015 | Thibodeaux | E01H 1/12 294/104 |
| 2019/0376271 | A1 * | 12/2019 | Null | B08B 9/045 |

FOREIGN PATENT DOCUMENTS

| | | | |
|---|---|---|---|
| CN | 211815932 U | * | 10/2020 |
| GB | 403766 | | 1/1934 |

* cited by examiner

*Primary Examiner* — Lori L Baker

(57) ABSTRACT

A garbage disposal access assembly for retrieving an object from a garbage disposal includes an annular sleeve that is insertable into a throat of a garbage disposal to facilitate an unobstructed view into the garbage disposal. A conduit is attached to the annular sleeve and a light emitter is integrated into the conduit to illuminate an interior of the garbage disposal when the light emitter is turned on. A pair of tongs is insertable through the annular sleeve and into the garbage disposal when the annular sleeve is inserted into the throat of the garbage disposal. The tongs are sufficiently elongated to facilitate the user to retrieve a lost object from the garbage disposal.

7 Claims, 5 Drawing Sheets

GARBAGE DISPOSAL ACCESS ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to garbage disposal devices and more particularly pertains to a new garbage disposal device for facilitating an object to be retrieved from a garbage disposal. The device includes an annular sleeve that is insertable into a throat of a garbage disposal, a lip disposed on the annular sleeve for supporting the annular ring and a conduit extending along the annular sleeve. The device includes a light emitter integrated into the conduit for illuminating an interior of the garbage disposal when the annular sleeve is inserted into the garbage disposal. The device includes a pair of tongs that are sufficiently elongated to reach through the annular sleeve to retrieve an object that was dropped into the garbage disposal.

(2) Description of Related Art Including Information Disclosed Under 37 CFR 1.97 and 1.98

The prior art relates to garbage disposal devices including a variety of garbage disposal access devices that each includes a sleeve insertable into a throat of a garbage disposal, a light emitter and a pair of tongs. The prior art discloses a garbage disposal viewer that includes an annular sleeve, a light emitter and mirrors attached to the annular sleeve. The prior art discloses a variety of elongated tongs that includes rings for grips and flattened grabbers.

BRIEF SUMMARY OF THE INVENTION

An embodiment of the disclosure meets the needs presented above by generally comprising an annular sleeve that is insertable into a throat of a garbage disposal to facilitate an unobstructed view into the garbage disposal. A conduit is attached to the annular sleeve and a light emitter is integrated into the conduit to illuminate an interior of the garbage disposal when the light emitter is turned on. A pair of tongs is insertable through the annular sleeve and into the garbage disposal when the annular sleeve is inserted into the throat of the garbage disposal. The tongs are sufficiently elongated to facilitate the user to retrieve a lost object from the garbage disposal.

Another embodiment of the disclosure includes a system which comprises a sink having a drain opening and a garbage disposal attached to the sink which has a throat and flaps integrated into the throat for partially closing the throat. An annular sleeve is insertable into the throat of the garbage disposal to facilitate an unobstructed view into the garbage disposal. A conduit is attached to the annular sleeve and a light emitter is integrated into the conduit to illuminate an interior of the garbage disposal when the light emitter is turned on. A pair of tongs is insertable through the annular sleeve and into the garbage disposal when the annular sleeve is inserted into the throat of the garbage disposal. The tongs are sufficiently elongated to facilitate the user to retrieve a lost object from the garbage disposal.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
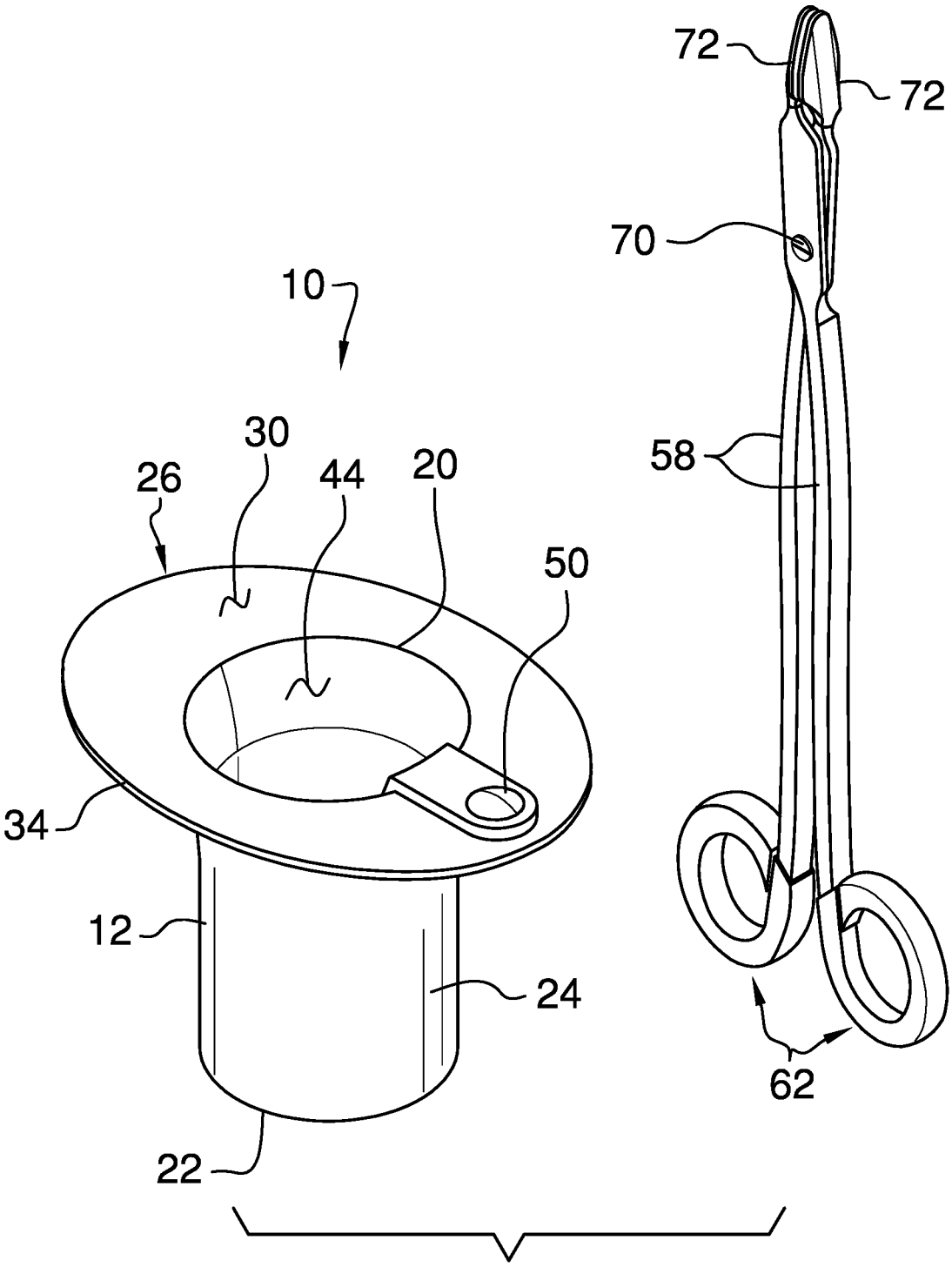
FIG. 1 is a perspective view of a garbage disposal access assembly according to an embodiment of the disclosure.
Figure 2:
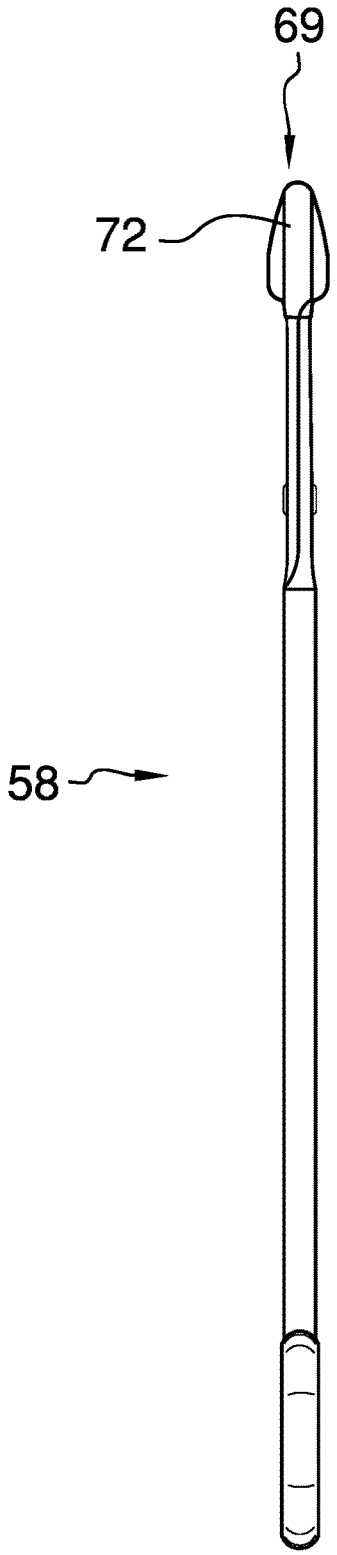
FIG. 2 is a right side view of an embodiment of the disclosure.
Figure 3:
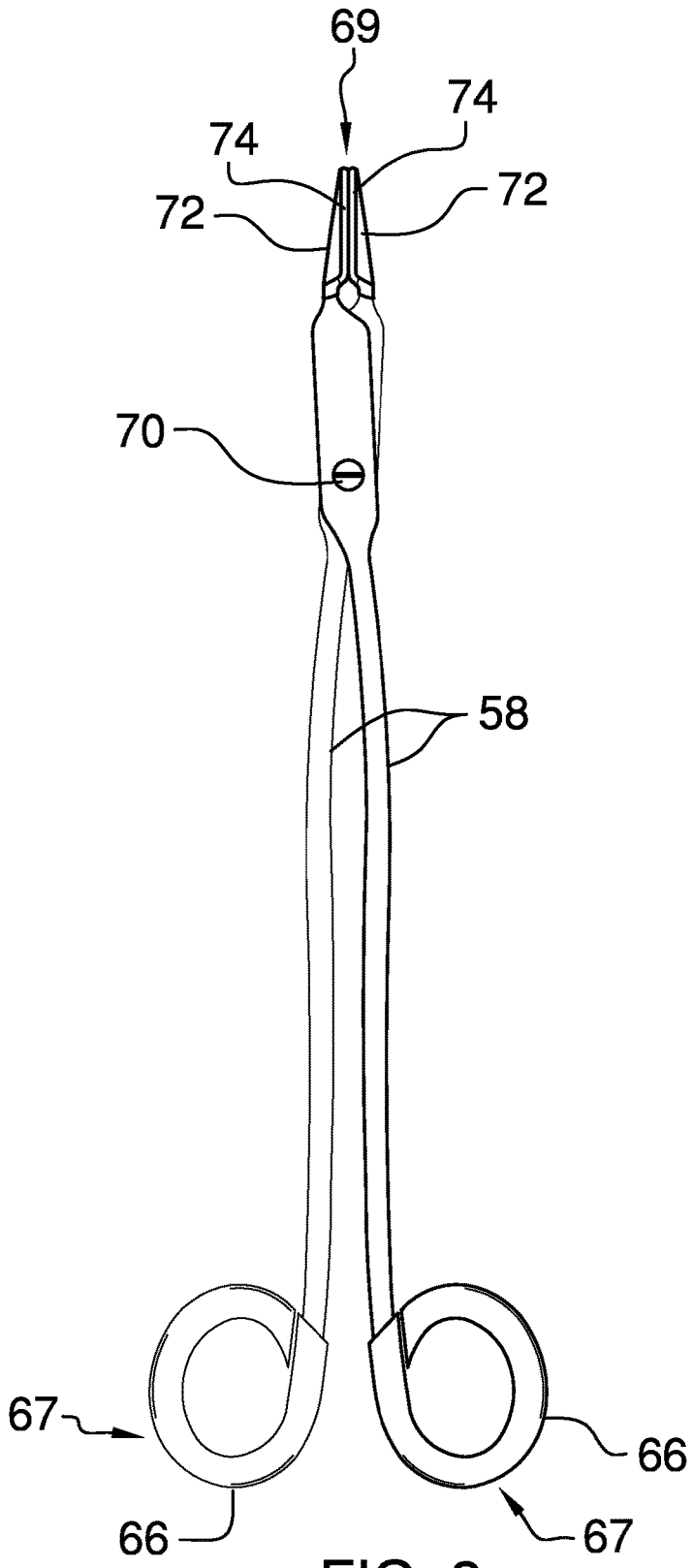
FIG. 3 is a front view of an embodiment of the disclosure.
Figure 4:
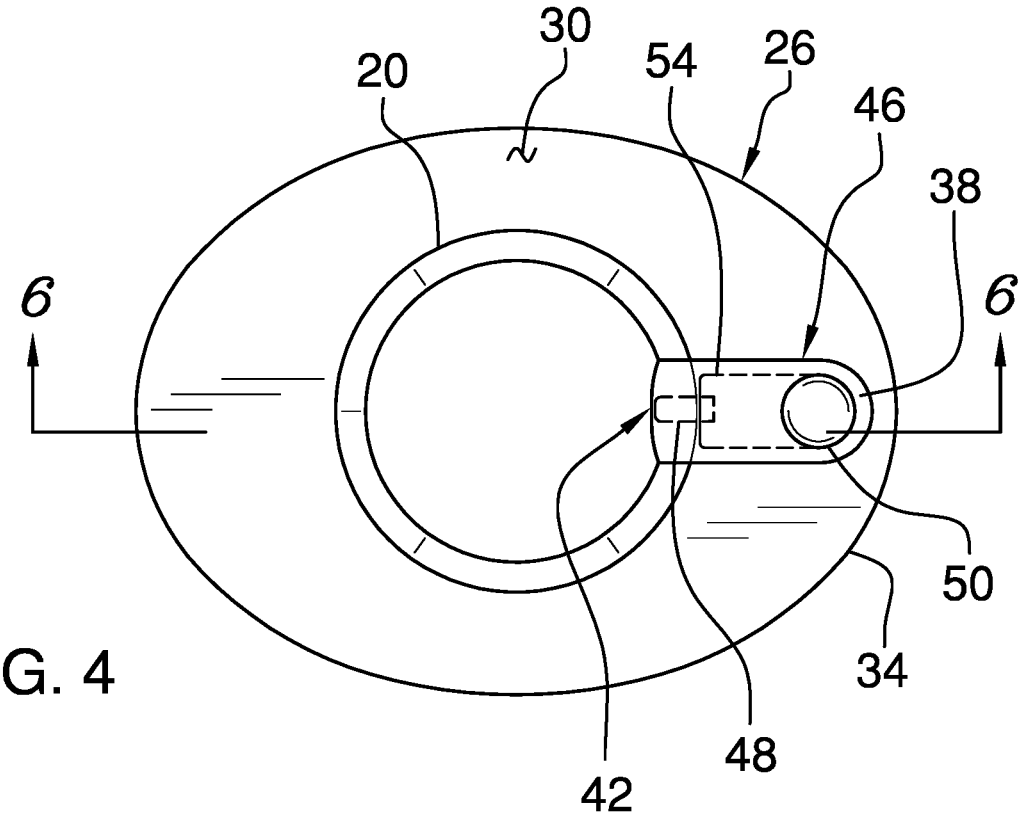
FIG. 4 is a top phantom view of an annular sleeve and a lip of an embodiment of the disclosure.
Figure 5:
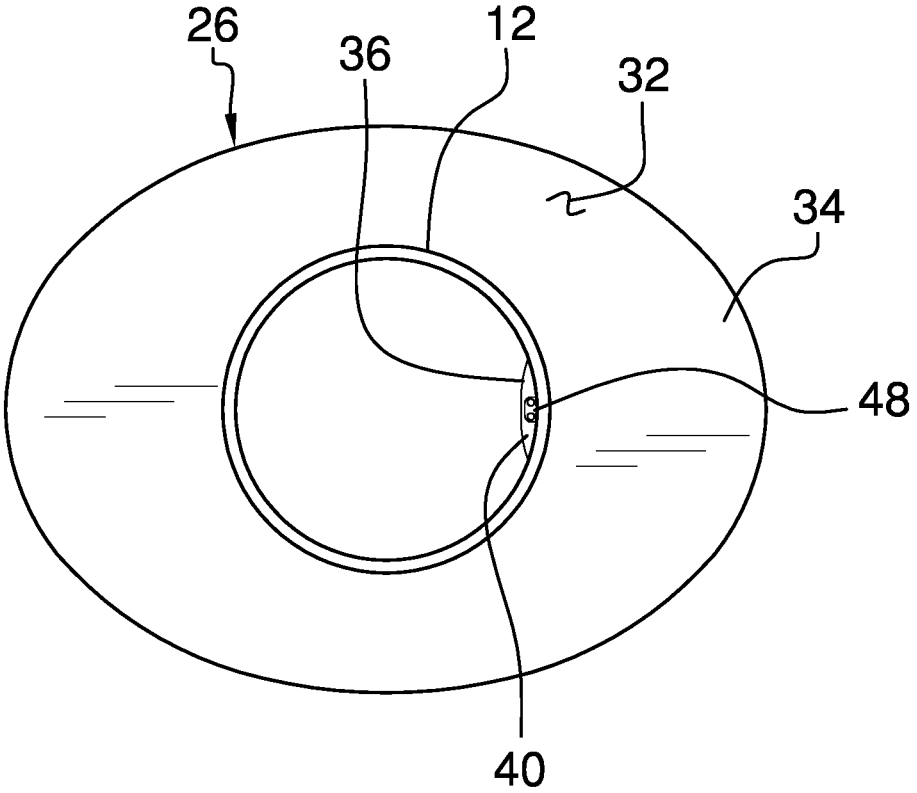
FIG. 5 is a bottom view of an annular sleeve and a lip of an embodiment of the disclosure.
Figure 6:
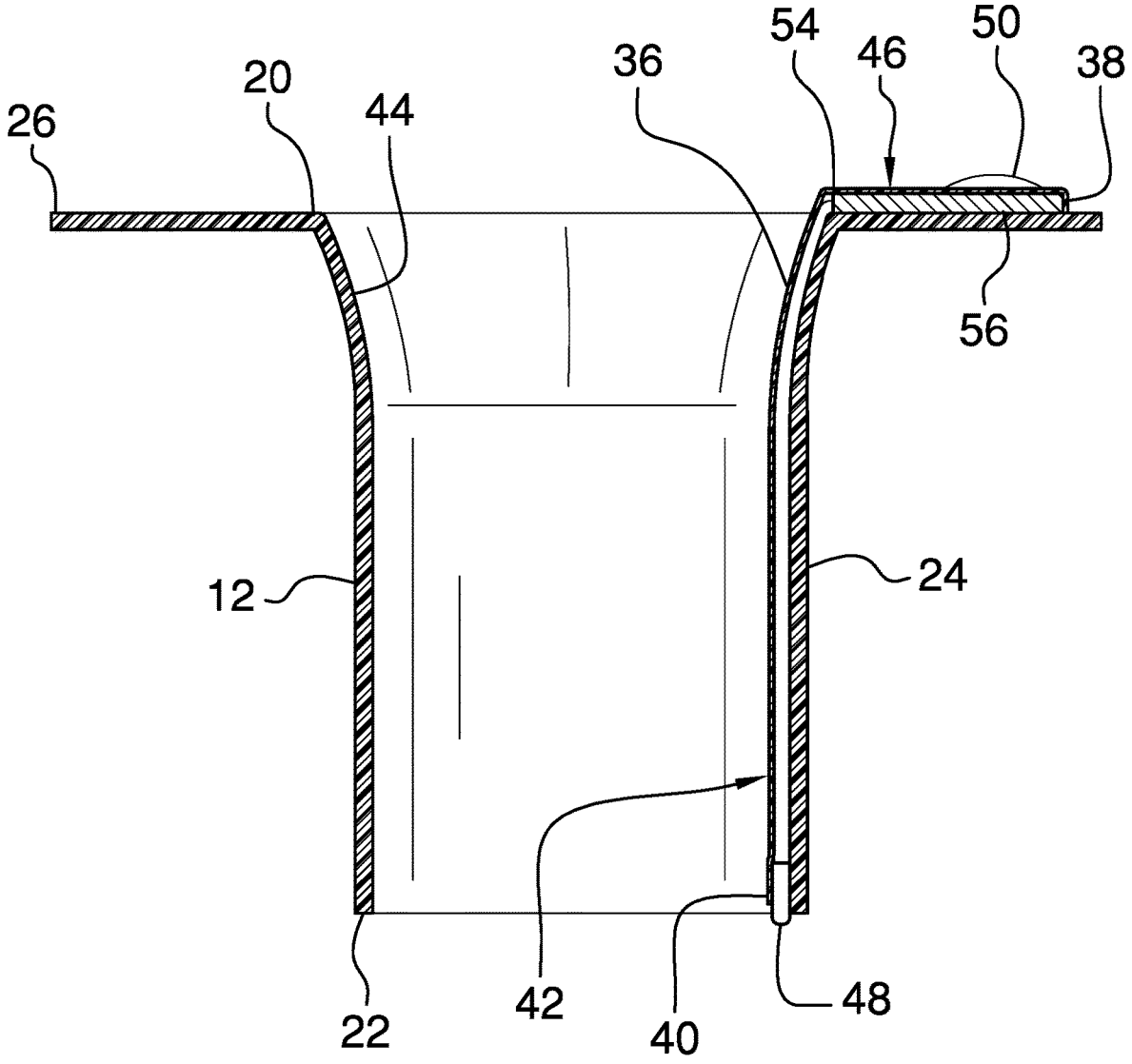
FIG. 6 is a cross sectional view taken along line 6-6 of FIG. 4 of an embodiment of the disclosure.
Figure 7:
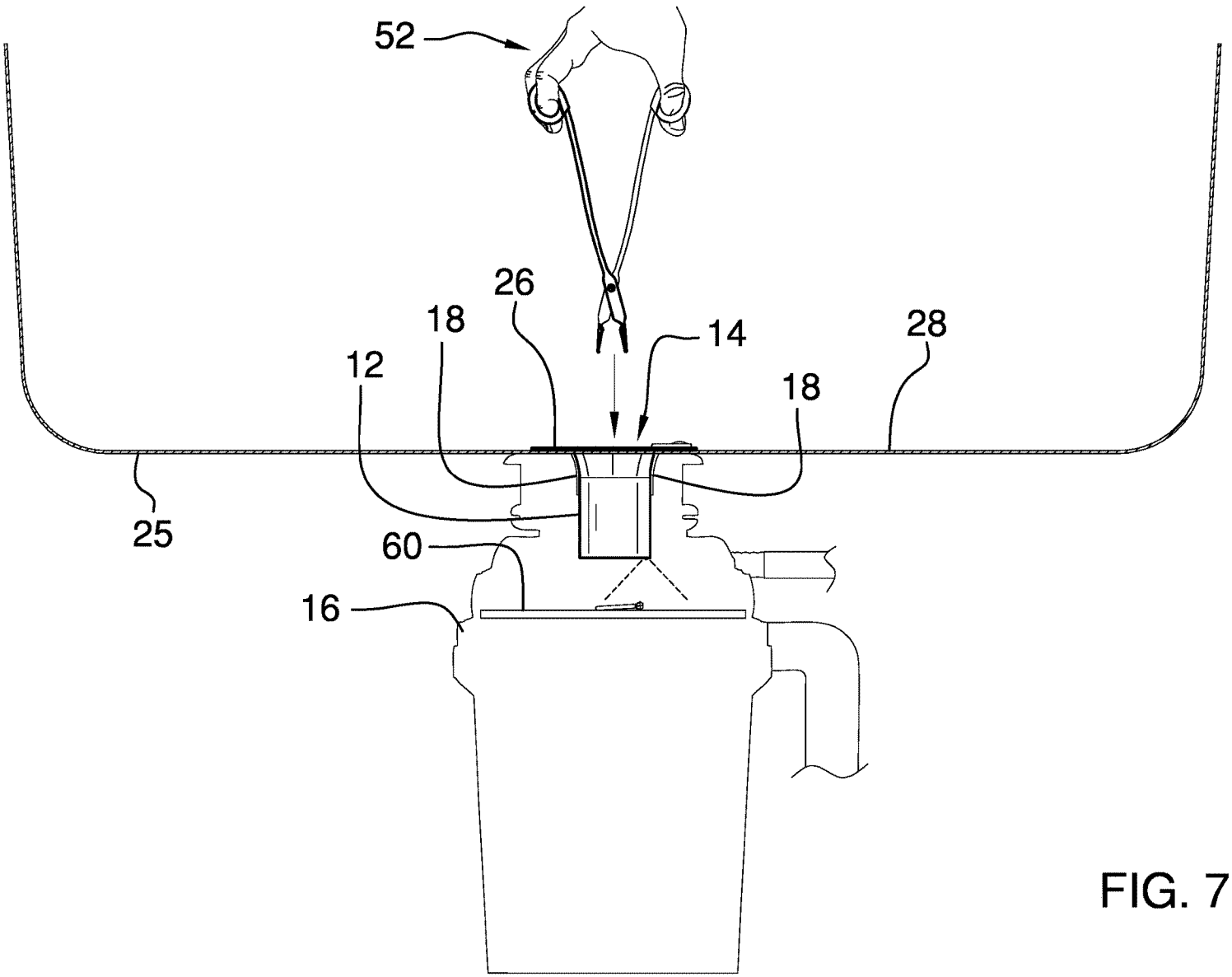
FIG. 7 is a perspective in-use view of an embodiment of the disclosure.

With reference now to the drawings, and in particular to FIGS. 1 through 7 thereof, a new garbage disposal device embodying the principles and concepts of an embodiment of the disclosure and generally designated by the reference numeral 10 will be described.

As best illustrated in FIGS. 1 through 7, the garbage disposal access assembly 10 generally comprises an annular sleeve 12 that is insertable into a throat 14 of a garbage disposal 16 such that the annular sleeve 12 spreads flaps 18 of the garbage disposal 16 thereby facilitating an unobstructed view into the garbage disposal 16. The annular sleeve 12 has an upper end 20, a lower end 22 and an outer wall 24 extending between the upper end 20 and the lower end 22. The outer wall 24 flares outwardly adjacent to the upper end 20 such that the upper end 20 has a diameter that is greater than a diameter of the lower end 22. The garbage disposal 16 may be an electric garbage disposal of any conventional design that would commonly be installed in a sink 25 of a residential kitchen.

A lip 26 is coupled to and extends laterally away from the annular sleeve 12 such that the lip 26 rests on an upper surface 28 of the sink 25 in which the garbage disposal 16 is integrated. In this way the annular sleeve 12 is inhibited from falling into the garbage disposal 16 when the annular sleeve 12 is inserted into the throat 14 of the garbage disposal 16. The lip 26 has a top surface 30, a bottom surface 32 and an outer edge 34 extending between the top surface 30 and the bottom surface 32. Additionally, the lip 26 extends away from the outer wall 24 of the annular sleeve 12 having the lip 26 extending around a full circumference of the outer wall 24. The lip 26 is aligned with the upper end 20 of the annular sleeve 12 and the outer edge 34 is continuously arcuate about the outer wall 24 of the annular sleeve 12. Furthermore, the lip 26 is elongated about a central axis of the lip 26 such that the outer edge 34 describes an ovoid shape. The bottom surface 32 of the lip 26 rests on the upper surface 28 of the sink 25 when the annular sleeve 12 is inserted into the throat 14 of the garbage disposal 16.

A conduit 36 is attached to each of the annular sleeve 12 and the lip 26 thereby facilitating the conduit 36 to be directed into the garbage disposal 16 when the annular sleeve 12 is inserted into the throat 14 of the garbage disposal 16. The conduit 36 has a top end 38 and a bottom end 40, and the conduit 36 has a first portion 42 extending along an inside surface 44 of the outer wall 24 of the annular sleeve 12. The first portion 42 extends between the upper end 20 and the lower end 22 of the annular sleeve 12, and the bottom end 40 of the conduit 36 is associated with the first portion 42. The conduit 36 has a second portion 46 extending along the top surface 30 of the lip 26 and the top end 38 of the conduit 36 is associated with the second portion 46. The second portion 46 extends from the upper end 20 of the annular sleeve 12 toward the outer edge 34 of the lip 26. Furthermore, the bottom end 40 is aligned with the lower end 22 of the annular sleeve 12 and the top end 38 is positioned between the outer edge 34 of the lip 26 and the annular sleeve 12.

A light emitter 48 is integrated into the conduit 36 thereby facilitating the light emitter 48 to be directed into the garbage disposal 16 when the annular sleeve 12 is inserted into the throat 14 of the garbage disposal 16. In this way the light emitter 48 can illuminate an interior of the garbage disposal 16 when the light emitter 48 is turned on, and the light emitter 48 is aligned with the bottom end 40 of the conduit 36. The light emitter 48 may comprise a light emitting diode or other type of electronic light emitter.

A power button 50 is movably integrated into the second portion 46 of the conduit 36 such that the power button 50 is accessible to a user 52 when the annular sleeve 12 is inserted into the throat 14 of the garbage disposal 16. The power button 50 is electrically coupled to the light emitter 48 for turning the light emitter 48 on and off. A power supply 54 is integrated into the second portion 46 of the conduit 36, the power supply 54 is electrically coupled to the power button 50 and the power supply 54 comprises at least one battery 56.

A pair of tongs 58 is provided and the pair of tongs 58 is insertable through the annular sleeve 12 and into the garbage disposal 16 when the annular sleeve 12 is inserted into the throat 14 of the garbage disposal 16. The tongs 58 are sufficiently elongated thereby facilitating the tongs 58 to extend to a bottom 60 of the garbage disposal 16 has grips 62 of the tongs 58 is exposed. In this way the tongs 58 facilitate the user 52 to retrieve the lost object 64 from the garbage disposal 16. Each of the tongs 58 has a closed ring 66 that is integrated into a top end 67 of the tongs 58 for receiving a user's finger 68 such that the closed ring 66 on the top end 67 of each of the tongs 58 defines the grips 62 of the tongs 58. Additionally, the pair of tongs 58 is pivotally attached together a pivot point 70 that is located closer to a bottom end 69 than the top end 67 of the tongs 58.

Each of the tongs 58 has a spade 72 that is integrated into the bottom end 69 of the tongs 58. The spade 72 on the bottom end 69 of each of the tongs 58 has a first surface 74 that is directed toward each other. Furthermore, the first surface 74 of the spade 72 on the top end 38 of each of the tongs 58 compresses against the object 64 when the tongs 58 are closed for retrieving the object 64 from the garbage disposal 16. The spade 72 on the top end 38 of each of the tongs 58 is comprised of a luminescent material thereby facilitating the spade 72 on the top end 38 of each of the tongs 58 be visible in a darkened environment.

In use, the annular sleeve 12 is inserted into the throat 14 of the garbage disposal 16 to facilitate an unobstructed view into the garbage disposal 16. Additionally, the light emitter 48 can be turned on to illuminate the interior of the garbage disposal 16. In this way the object 64, which could be anything that can fit through the throat 14 of the garbage disposal 16, is clearly visible to the user 52. The user 52 employs the tongs 58 to retrieve the object 64 from the garbage disposal 16 and the annular sleeve 12 is removed from the throat 14 of the garbage disposal 16. In this way an object 64 can be retrieved from the garbage disposal 16 without requiring the garbage disposal 16 to be disassembled.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A garbage disposal access assembly for facilitating a lost object to be retrieved from a garbage disposal in a sink, said assembly comprising:

an annular sleeve being insertable into a throat of a garbage disposal such that said annular sleeve spreads flaps of the garbage disposal thereby facilitating an unobstructed view into the garbage disposal;

a lip being coupled to and extending laterally away from said annular sleeve such that said lip rests on an upper surface of a sink in which the garbage disposal is integrated thereby inhibiting said annular sleeve from falling into the garbage disposal when said annular sleeve is inserted into the throat of the garbage disposal;

a conduit being attached to each of said annular sleeve and said lip thereby facilitating said conduit to be directed into the garbage disposal when said annular sleeve is inserted into the throat of the garbage disposal;

a light emitter being integrated into said conduit thereby facilitating said light emitter to be directed into the garbage disposal when said annular sleeve is inserted into the throat of the garbage disposal wherein said light emitter is configured to illuminate an interior of the garbage disposal when said light emitter is turned on; and a pair of tongs, said pair of tongs being insertable through said annular sleeve and into the garbage disposal when said annular sleeve is inserted into the throat of the garbage disposal, said tongs being sufficiently elongated thereby facilitating said tongs to extend to a bottom of the garbage disposal having grips of said tongs being exposed wherein said tongs are configured to facilitate the user to retrieve the lost object from the garbage disposal;

wherein each of said tongs has a closed ring being integrated into a first end of said tongs for receiving a user's finger;

wherein each of said tongs has a spade being integrated into a second end of said tongs;

wherein said pair of tongs being pivotally attached together a pivot point being located closer to said second end than said first end of said tongs;

wherein said spade on said second end of each of said tongs having a first surface being directed toward each other thereby facilitating said first surface of said spade on said second end of each of said tongs to compress against the object when said tongs are closed for retrieving the object from the garbage disposal; and wherein said spade on said second end of each of said tongs is comprised of a luminescent material thereby facilitating said spade on said second end of each of said tongs be visible in a darkened environment.

2. The assembly according to claim 1, wherein:

said annular sleeve has an upper end, a lower end and an outer wall extending between said upper end and said lower end, said outer wall flaring outwardly adjacent to said upper end such that said upper end has a diameter being greater than a diameter of said lower end;

said lip has a top surface, a bottom surface and an outer edge extending between said top surface and said bottom surface, said lip extending away from said outer wall of said annular sleeve having said lip extending around a full circumference of said outer wall, said lip being aligned with said upper end of said annular sleeve, said outer edge being continuously arcuate about said outer wall of said annular sleeve, said lip is elongated about a central axis of said lip such that said outer edge describes an ovoid shape, said bottom surface of said lip resting on the upper surface of the sink when said annular sleeve is inserted into the throat of the garbage disposal.

3. The assembly according to claim 2, wherein:

said conduit has a top end and a bottom end; and said light emitter is aligned with said bottom end of said conduit.

4. A garbage disposal access assembly for facilitating a lost object to be retrieved from a garbage disposal in a sink, said assembly comprising:

an annular sleeve being insertable into a throat of a garbage disposal such that said annular sleeve spreads flaps of the garbage disposal thereby facilitating an unobstructed view into the garbage disposal;

a lip being coupled to and extending laterally away from said annular sleeve such that said lip rests on an upper surface of a sink in which the garbage disposal is integrated thereby inhibiting said annular sleeve from falling into the garbage disposal when said annular sleeve is inserted into the throat of the garbage disposal;

a conduit being attached to each of said annular sleeve and said lip thereby facilitating said conduit to be directed into the garbage disposal when said annular sleeve is inserted into the throat of the garbage disposal, wherein said conduit has a top end and a bottom end;

a light emitter being integrated into said conduit thereby facilitating said light emitter to be directed into the garbage disposal when said annular sleeve is inserted into the throat of the garbage disposal wherein said light emitter is configured to illuminate an interior of the garbage disposal when said light emitter is turned on, wherein said light emitter is aligned with said bottom end of said conduit;

a pair of tongs, said pair of tongs being insertable through said annular sleeve and into the garbage disposal when said annular sleeve is inserted into the throat of the garbage disposal, said tongs being sufficiently elongated thereby facilitating said tongs to extend to a bottom of the garbage disposal having grips of said tongs being exposed wherein said tongs are configured to facilitate the user to retrieve the lost object from the garbage disposal;

wherein said annular sleeve has an upper end, a lower end and an outer wall extending between said upper end and said lower end said outer wall flaring outwardly adjacent to said upper end such that said upper end has a diameter being greater than a diameter of said lower end;

wherein said lip has a top surface, a bottom surface and an outer edge extending between said top surface and said bottom surface, said lip extending away from said outer wall of said annular sleeve having said lip extending around a fall circumference of said outer wall, said lip being aligned with said upper end of said annular sleeve, said outer edge being continuously arcuate about said outer wall of said annular sleeve, said lip is elongated about a central axis of said lip such that said outer edge describes an ovoid shape, said bottom surface of said lip resting on the upper surface of the sink when said annular sleeve is inserted into the throat of the garbage disposal;

said conduit has a first portion extending along an inside surface of said outer wall of said annular sleeve, said first portion extending between said upper end and said lower end of said annular sleeve, said first end of said conduit being associated with said first portion; and said conduit has a second portion extending along said top surface of said lip, said second portion extending from said upper end of said annular sleeve toward said outer edge of said lip, said first end being aligned with said lower end of said annular sleeve, said second end of said conduit being associated with said second portion, said second end being positioned between said outer edge of said lip and said annular sleeve.

5. The assembly according to claim 4, further comprising:

a power button being movably integrated into said second portion of said conduit such that said power button is accessible to a user when said annular sleeve is inserted into the throat of the garbage disposal, said power button being electrically coupled to said light emitter for turning said light emitter on and off; and a power supply being integrated into said second portion of said conduit, said power supply being electrically coupled to said power button, said power supply comprising at least one battery.

6. The garbage disposal access assembly of claim 1, further comprising:

said annular sleeve having an upper end, a lower end and an outer wall extending between said upper end and said lower end, said outer wall flaring outwardly adjacent to said upper end such that said upper end has a diameter being greater than a diameter of said lower end;

said lip having a top surface, a bottom surface and an outer edge extending between said top surface and said bottom surface, said lip extending away from said outer wall of said annular sleeve having said lip extending around a fall circumference of said outer wall, said lip being aligned with said upper end of said annular sleeve, said outer edge being continuously arcuate about said outer wall of said annular sleeve, said lip being elongated about a central axis of said lip such that said outer edge describes an ovoid shape, said bottom surface of said lip resting on the upper surface of the sink when said annular sleeve is inserted into the throat of the garbage disposal;

said conduit having a top end and a bottom end, said conduit having a first portion extending along an inside surface of said outer wall of said annular sleeve, said first portion extending between said upper end and said lower end of said annular sleeve, said conduit having a second portion extending along said top surface of said lip, said second portion extending from said upper end of said annular sleeve toward said outer edge of said lip, said first end of said conduit being associated with said first portion, said first end being aligned with said lower end of said annular sleeve, said second end of said conduit being associated with said second portion, said second end being positioned between said outer edge of said lip and said annular sleeve;

said light emitter being aligned with said bottom end of said conduit;

a power button being movably integrated into said second portion of said conduit such that said power button is accessible to a user when said annular sleeve is inserted into the throat of the garbage disposal, said power button being electrically coupled to said light emitter for turning said light emitter on and off; and a power supply being integrated into said second portion of said conduit, said power supply being electrically coupled to said power button, said power supply comprising at least one battery.

7. A garbage disposal access system for facilitating a lost object to be retrieved from a garbage disposal in a sink, said assembly comprising:

a sink having a drain opening;

a garbage disposal being attached to said sink, said garbage disposal having a throat and flaps integrated into said throat for partially closing said throat;

an annular sleeve being insertable into said throat of said garbage disposal such that said annular sleeve spreads flaps of said garbage disposal thereby facilitating an unobstructed view into said garbage disposal, said annular sleeve having an upper end, a lower end and an outer wall extending between said tipper end and said lower end, sa id outer wall flaring outwardly adjacent to said upper end such that said upper end has a diameter being greater than a diameter of said lower end;

a lip being coupled to and extending laterally away from said annular sleeve such that said lip rests on an upper surface of said sink in which said garbage disposal is integrated thereby inhibiting said annular sleeve from falling into said garbage disposal when said annular sleeve is inserted into said throat of said garbage disposal, said lip having a top surface, a bottom surface and an outer edge extending between said top surface and said bottom surface, said lip extending away from said outer wall of said annular sleeve having said lip extending around a full circumference of said outer wall, said lip being aligned with said upper end of said annular sleeve, said outer edge being continuously arcuate about said outer wall of said annular sleeve, said lip being elongated about a central axis of said lip such that said outer edge describes an ovoid shape, said bottom surface of said lip resting on said upper surface of said sink when said annular sleeve is inserted into said throat of said garbage disposal;

a conduit being attached to each of said annular sleeve and said lip thereby facilitating said conduit to be directed into said garbage disposal when said annular sleeve is inserted into said throat of said garbage disposal, said conduit having a top end and a bottom end, said conduit having a first portion extending along an inside surface of said outer wall of said annular sleeve, said first portion extending between said upper end and said lower end of said annular sleeve, said conduit having a second portion extending along said top surface of said lip, said second portion extending from said upper end of said annular sleeve toward said outer edge of said lip, said first end of said conduit being associated with said first portion, said first end being aligned with said lower end of said annular sleeve, said second end of said conduit being associated with said second portion, said second end being positioned between said outer edge of said lip and said annular sleeve;

a light emitter being integrated into said conduit thereby facilitating said light emitter to be directed into said garbage disposal when said annular sleeve is inserted into said throat of said garbage disposal to illuminate an interior of said garbage disposal when said light emitter is turned on, said light emitter being aligned with said bottom end of said conduit;

a power button being movably integrated into said second portion of said conduit such that said power button is accessible to a user when said annular sleeve is inserted into said throat of said garbage disposal, said power button being electrically coupled to said light emitter for turning said light emitter on and off;

a power supply being integrated into said second portion of said conduit, said power supply being electrically coupled to said power button, said power supply comprising at least one battery; and a pair of tongs, said pair of tongs being insertable through said annular sleeve and into said garbage disposal when said annular sleeve is inserted into said throat of said garbage disposal, said tongs being sufficiently elongated thereby facilitating said tongs to extend to a bottom of said garbage disposal having grips of said tongs being exposed wherein said tongs are configured to facilitate the user to retrieve a lost object from said garbage disposal, each of said tongs having a closed ring being integrated into a first end of said tongs for receiving a user's finger, each of said tongs having a spade being integrated into a second end of said tongs, said pair of tongs being pivotally attached together a pivot point being located closer to said second end than said first end of said tongs, said spade on said second end of each of said tongs having a first surface being directed toward each other thereby facilitating said first surface of said spade on said second end of each of said tongs to compress against the object when said tongs are closed for retrieving the object from said garbage disposal, said spade on said second end of each of said tongs being comprised of a luminescent material thereby facilitating said spade on said second end of each of said tongs be visible in a darkened environment.

* * * * *